US012460644B2

(12) United States Patent
Kim et al.

(10) Patent No.: US 12,460,644 B2
(45) Date of Patent: Nov. 4, 2025

(54) SCROLL COMPRESSOR

(71) Applicant: Hanon Systems, Daejeon (KR)

(72) Inventors: Kwang Jin Kim, Daejeon (KR); Kyung Jae Lee, Daejeon (KR); Jong Hyun Jeon, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/292,979

(22) PCT Filed: Apr. 20, 2023

(86) PCT No.: PCT/KR2023/005344
§ 371 (c)(1),
(2) Date: Jan. 29, 2024

(87) PCT Pub. No.: WO2024/058333
PCT Pub. Date: Mar. 21, 2024

(65) Prior Publication Data

US 2025/0207593 A1 Jun. 26, 2025

(30) Foreign Application Priority Data

Sep. 13, 2022 (KR) ..... 10-2022-0115087

(51) Int. Cl.
*F04C 29/12* (2006.01)
*F04C 18/02* (2006.01)

(52) U.S. Cl.
CPC ..... *F04C 29/12* (2013.01); *F04C 18/0215* (2013.01); *F04C 2240/30* (2013.01)

(58) Field of Classification Search
CPC .. F04C 18/02; F04C 18/0215; F04C 2240/30; F04C 23/02; F04C 27/00; F04C 29/00; F04C 29/12
See application file for complete search history.

(56) References Cited

FOREIGN PATENT DOCUMENTS

| | | | |
|---|---|---|---|
| CN | 108425842 | A | 8/2018 |
| JP | 2001132629 | A | 5/2001 |
| JP | 2023513787 | A | 4/2023 |
| KR | 100315302 | B1 | 2/2002 |
| KR | 20180094483 | A | 8/2018 |
| KR | 20210118666 | A | 10/2021 |
| KR | 20210118743 | A | 10/2021 |
| KR | 20220118896 | A | 8/2022 |

*Primary Examiner* — Anthony Ayala Delgado
(74) *Attorney, Agent, or Firm* — Shumaker, Loop & Kendrick, LLP; James D. Miller

(57) ABSTRACT

A scroll compressor, more particularly, a scroll compressor capable of minimizing deformation of a valve plate of an injection valve assembly, and maintaining a flat shape of the gasket retainer, since deformation is not transmitted to an inner side portion of the gasket retainer supporting an injection valve even when the bead portion of the gasket retainer is pressed.

12 Claims, 9 Drawing Sheets

SCROLL COMPRESSOR

CROSS REFERENCE TO RELATED PATENT APPLICATIONS

This is a U.S. national phase patent application of PCT/KR2023/005344 filed Apr. 20, 2023, which claims the benefit of and priority to Korean Patent Application No. 10-2022-0115087, filed on Sep. 13, 2022, the entire contents of each of which are incorporated herein by reference.

TECHNICAL FIELD

The present disclosure relates to a scroll compressor, more particularly, a scroll compressor capable of minimizing deformation of a valve plate of an injection valve assembly, and maintaining a flat shape of a gasket retainer, since deformation is not transmitted to an inner side portion of the gasket retainer supporting an injection valve even when the bead portion of the gasket retainer is pressed.

BACKGROUND ART

In general, an air conditioning (A/C) device is installed in a vehicle to cool or heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion. Depending on methods of transmitting driving power, the reciprocating compressors are classified into a crank compressor which transmits power to a plurality of pistons using a crank, and a swash plate compressor which transmits power to a shaft on which a swash plate is installed. The rotary compressors are classified into a vane rotary compressor which uses a rotating rotary shaft and vanes, and a scroll compressor which uses an orbiting scroll and a fixed scroll.

The scroll compressor has an advantage in that the scroll compressor may obtain a relatively higher compression ratio than other compressors, smoothly perform processes of introducing, compressing, and discharging the refrigerant, and thus obtain stable torque. Therefore, the scroll compressor is widely used to compress the refrigerant in an air conditioning device or the like.

A scroll compressor of a prior art disclosed in a prior art literature 1 (Korea patent application publication no. 2018-0094483) goes through a series of process in which only a suction pressure refrigerant is sucked into a compression chamber and compressed and discharged to the outside. However, the conventional scroll compressor had a problem in that a refrigerant discharge amount being discharged from the compression chamber was determined, leading to a limitation in improving the performance and efficiency of the compressor.

In order to solve the above-mentioned problem, a prior art literature 2 (Korea patent application publication no. 2021-0118743), as illustrated in FIGS. 1 and 2, discloses a scroll compressor having an injection valve assembly 700, which includes an injection valve configured to open or close an injection flow path guiding a middle-pressure refrigerant which is introduced from the outside of a compressor into a compression chamber C, and a leakage prevention means.

Specifically, the injection valve assembly 700 includes a cover plate 710, an injection valve 720, a valve plate 730, and a gasket retainer 790 as a leakage prevention means. The gasket retainer 790 is compressed between the cover plate 710 and the valve plate 730 to seal therebetween, and accordingly, the injection valve 720 is compressed between the cover plate 710 and the gasket retainer 790 and fixed therebetween. To this end, the gasket retainer 790 includes a bead portion 792 protruding toward the cover plate 710 from an upper surface of the gasket retainer.

However, since the bead portion 792 is not formed around a third fastening hole 796 through which a fastening bolt penetrates in the gasket retainer 790, there is a problem in that the valve plate 730 is bent when the injection valve assembly 700 is fastened to a rear housing 130 by a fastening bolt 770 and there is no portion that supports a fastening force of the bolt near the third fastening hole 796. That is, the valve plate 730 may be deformed to be convex in a direction opposite to a direction that the valve plate 730 is directed toward the gasket retainer 790.

In addition, since the bead portion 792 and the retainer portion 794 are all connected to one another in the gasket retainer 790 except a main flow hole 790*c* and a pair of the auxiliary flow holes 790*d*, there is a problem in that the deformation formed by compression applied to the bead portion 792 is transmitted to the retainer portion 794, which is an inner portion supporting the injection valve.

As described above, support for the injection valve 720 is not reliably performed and thus, may become unstable and generate noise since the valve plate 730 and the gasket retainer 790 are deformed.

SUMMARY

An object of the present disclosure is to provide a scroll compressor capable of minimizing deformation of a valve plate of an injection valve assembly, and maintaining a flat shape of the gasket retainer since deformation is not transmitted to an inner side portion of the gasket retainer supporting an injection valve even when a bead portion of a gasket retainer is pressed.

Technical problems to be solved by the present disclosure are not limited to the above-mentioned technical problems, and other technical problems, which are not mentioned above, may be clearly understood from the following descriptions by those skilled in the art to which the present disclosure pertains.

One embodiment is a scroll compressor, including: a housing; a motor provided inside the housing; a rotary shaft configured to be rotated by the motor; an orbiting scroll configured to orbit in conjunction with the rotary shaft; and a fixed scroll configured to define a compression chamber together with the orbiting scroll, and the housing may include a rear housing which defines a discharge chamber configured to accommodate a refrigerant discharged from the compression chamber; an injection valve assembly configured to define an introduction chamber into which a refrigerant is introduced from an outside of the housing in the rear housing and guide a refrigerant of the introduction chamber to the compression chamber is provided between the fixed scroll and the rear housing, the injection valve assembly may include: a cover plate coupled to the rear housing and having an inflow port into which the refrigerant from the introduction chamber is introduced; a valve plate coupled to the cover plate and having an outflow port through which the refrigerant introduced from the inflow port is discharged; a gasket retainer interposed between the cover plate and the valve plate and configured to prevent a leak of a refrigerant; and an injection valve interposed between the cover plate and the gasket retainer and configured to open or close the inflow port, and the gasket retainer may include; a retainer portion formed to be inclined in a direction in which the injection valve is opened; a plurality of fastening holes formed to penetrate on a radially outside of the retainer portion so as to allow a fastening bolt to be inserted thereinto; a first half-bead protruding from one surface and extending radially inward of the plurality of the fastening holes while surrounding the retainer portion; and a second half-bead protruding from one surface and extending radially outward of the plurality of fastening holes while surrounding the first half-bead.

According to the embodiment, the first half-bead and the second half-bead may contact each other to form a convex full-bead at a portion spaced apart from the plurality of fastening holes.

According to the embodiment, each of the first half-bead and the second half-bead may have a quarter circular cross-section, and the first half-bead and the second half-bead may contact each other to form a semi-circular cross-section at a portion spaced apart from the plurality of fastening holes.

According to the embodiment, the first half-bead and the second half-bead may be formed to protrude from a bottom surface of a gasket retainer facing the valve plate.

According to the embodiment, a hole extending to surround an outside of one end of the retainer portion may be formed in the gasket retainer so that the first half-bead adjoining the one end of the retainer portion from which an inclination starts are not directly connected to the one end.

According to the embodiment, the retainer portion may be formed to be inclined by a cut of a body of the gasket retainer, and the gasket retainer may further include a pair of wing portions connecting both sides of the retainer portion to the body of the gasket retainer facing each of the both sides of the retainer portion to maintain an inclination angle of the retainer portion, and a main flow hole may be formed on one side of the pair of wing portions, and a pair of auxiliary flow holes may be formed on another side of the pair of wing portions, and a first auxiliary flow hole disposed on an outer side of the pair of auxiliary flow holes may extend longer than a second auxiliary flow hole disposed on an inner side of the pair of auxiliary flow holes to surround the outside of the one end of the retainer portion.

According to the embodiment, the first auxiliary flow hole may be disposed on a same line as a line of the second auxiliary flow hole, or extend to beyond the line of the second auxiliary flow hole.

According to the embodiment, the pair of wing portions may be connected to both sides of another end which are opposite to the one end of the retainer portion from which an inclination starts.

According to the embodiment, the retainer portion may be provided in plurality, and may include a first retainer portion, and a second retainer portion spaced apart from the first retainer portion, and the first auxiliary flow hole of the first retainer portion may extend toward the main flow hole of the second retainer portion, and the first auxiliary flow hole of the second retainer portion may extend toward the main flow hole of the first retainer portion.

According to the embodiment, the main flow hole may at least partially extend along a circumferential direction of the gasket retainer while surrounding the another end which are opposite to the one end of the retainer portion from which an inclination starts.

According to the embodiment, a stepped portion may be formed on a circumference of a surface of the valve plate facing the gasket retainer, and the stepped portion may be formed by a step forming surface protruding toward the gasket retainer from the circumference of the valve plate, and the first half-bead and the second half-bead may face the step forming surface.

Another embodiment is a scroll compressor, including: a housing; a motor provided inside the housing; a rotary shaft configured to be rotated by the motor; an orbiting scroll configured to orbit in conjunction with the rotary shaft; and a fixed scroll configured to define a compression chamber together with the orbiting scroll, and the housing may include a rear housing which defines a discharge chamber configured to accommodate a refrigerant discharged from the compression chamber; an injection valve assembly configured to define an introduction chamber into which a refrigerant is introduced from an outside of the housing in the rear housing and guide a refrigerant of the introduction chamber to the compression chamber is provided between the fixed scroll and the rear housing, and the injection valve assembly may include: a cover plate coupled to the rear housing and having an inflow port into which the refrigerant from the introduction chamber is introduced; a valve plate coupled to the cover plate and having an outflow port through which the refrigerant introduced from the inflow port is discharged; a gasket retainer interposed between the cover plate and the valve plate and configured to prevent a leak of a refrigerant; and an injection valve interposed between the cover plate and the gasket retainer and configured to open or close the inflow port, and the gasket retainer may include; a retainer portion formed to be inclined in a direction in which the injection valve is opened; a bead portion protruding from one surface and surrounding the retainer portion, and a hole extending to surround an outside of one end of the retainer portion may be formed in the gasket retainer so that the bead portion adjoining the one end from which an inclination starts in the retainer portion is not directly connected to the one end.

According to the present disclosure, it is possible to increase a discharge amount of a refrigerant being discharged from a compression chamber thanks to introduction of a middle-pressure refrigerant as well as a suction pressure refrigerant into a compression chamber of a scroll compressor, thereby the performance and efficiency of the compressor can be improved.

In addition, since the gasket retainer includes a first half-bead extending radially inward of a plurality of fastening holes while surrounding the retainer portion and a second half-bead extending radially outward of the plurality of fastening holes while surrounding the retainer portion, the deformation of the valve plate may be minimized since the fastening force of a bolt may be supported around the fastening hole of the gasket retainer when the injection valve assembly is fastened by a fastening bolt to the rear housing.

In particular, it is possible to prevent deformation of the valve plate through ensuring a uniform surface pressure since the first half-bead and the second half-bead are configured, respectively, around the fastening holes in which a surface pressure is intense so as to be capable of supporting the fastening bolt, and a full-bead can be formed as the first half-bead and the second half-bead contact each other at a portion (a space between adjacent fastening holes) which is spaced apart from the fastening hole and has a weak surface pressure.

In addition, deformation generated when the bead portion is pressed is not transmitted to an inner side portion which supports the injection valve, since a hole extending to surround an outer side of one end of the retainer portion is formed in the gasket retainer, so that the bead portion (first half-bead) adjoining one end from which an inclination starts in the retainer portion is not directly connected to the one end.

In particular, since the bead portion is not directly connected from the one end of the retainer portion which supports a starting point (reference point) in which opening or closing of the injection valve is carried out, deformation is not transmitted, and a pair of wing portions are connected to the other end of the retainer portion as a minimum connection, thereby the injection valve can be reliably supported.

As described above, deformation of the valve plate and the gasket retainer is minimized so that the support for the injection valve can be reliably carried out and operations can be performed stably.

The effects of the present disclosure are not limited to the above-mentioned effects, and it should be understood that the effects of the present disclosure include all effects that may be derived from the detailed description of the present disclosure or the appended claims.

DESCRIPTION OF AN EMBODIMENT

Figure 1:
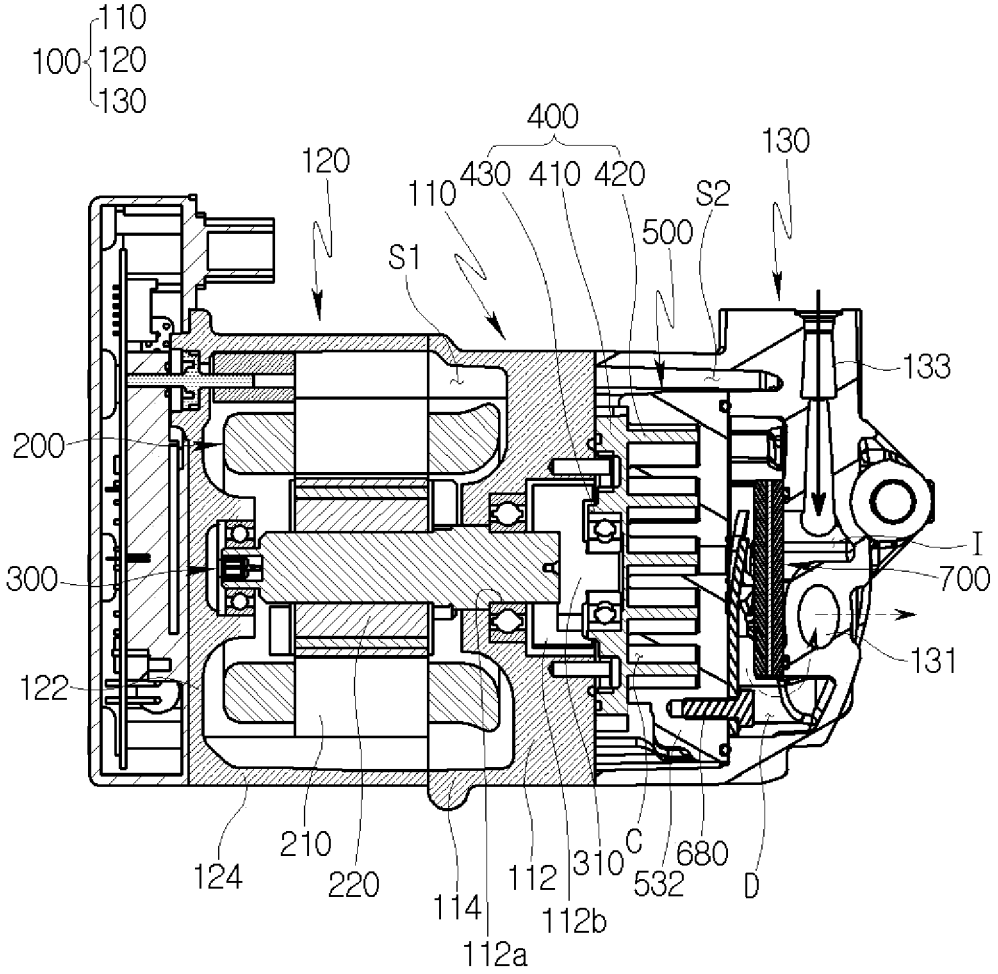
FIG. 1 is a cross-sectional view that illustrates a conventional scroll compressor.

Hereinafter, exemplary embodiments of a scroll compressor according to the present disclosure will be described with reference to the accompanying drawings.

In addition, the terms used below are defined considering the functions in the present disclosure and may vary depending on the intention of a user or an operator or a usual practice. The following embodiments are not intended to limit the protection scope of the present disclosure but just exemplary constituent elements disclosed claims in the present disclosure.

A part irrelevant to the description will be omitted to clearly describe the present disclosure, and the same or similar constituent elements will be designated by the same reference numerals throughout the specification. Throughout the specification, unless explicitly described to the contrary, the word "comprise/include" and variations such as "comprises/includes" or "comprising/including" will be understood to imply the inclusion of stated elements, not the exclusion of any other elements.

Figure 2:
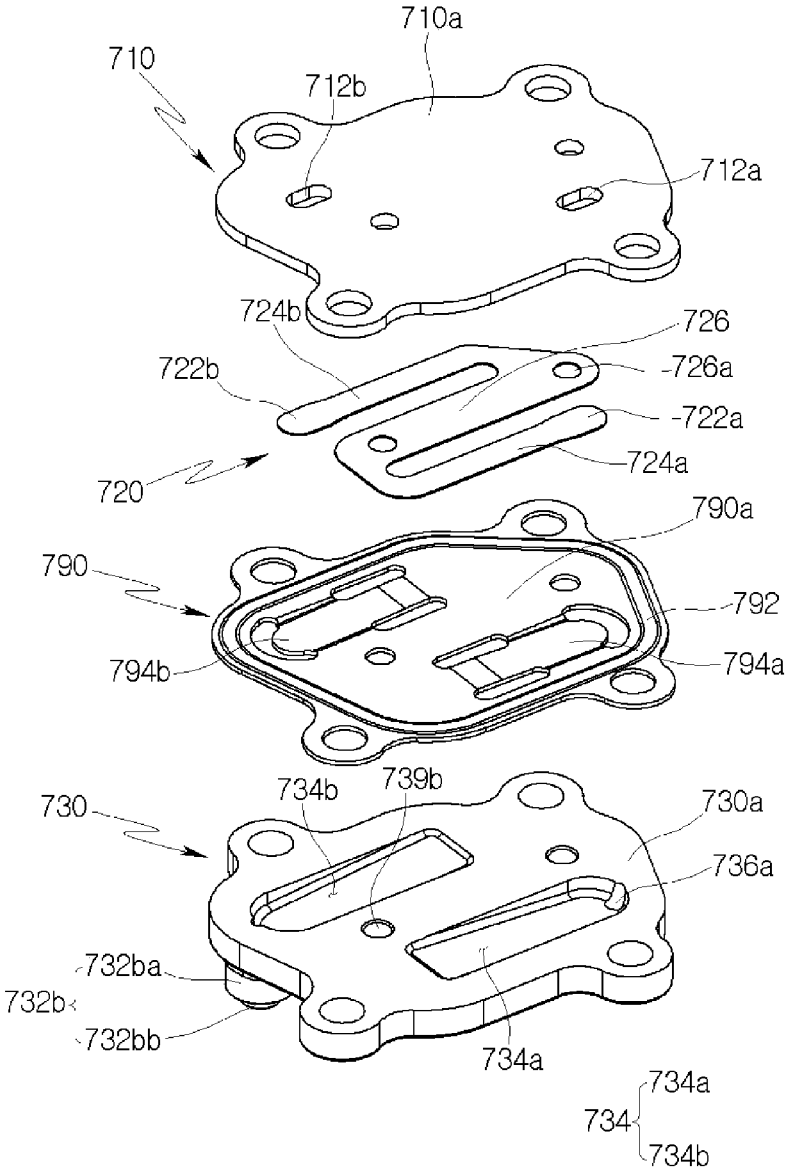
FIG. 2 is an exploded perspective view that illustrates a state in which an injection valve of FIG. 1 is separated.

The scroll compressor according to the embodiment of the present disclosure may include a housing 100, a motor 200 provided in the housing 100, a rotary shaft 300 configured to be rotated by the motor 200, an orbiting scroll 400 configured to orbit in conjunction with the rotary shaft 300, a fixed scroll 500 configured to define compression chambers C together with the orbiting scroll 400, and a discharge valve 600 disposed on one surface of the fixed scroll 500 and configured to open or close a discharge opening 512 of the fixed scroll from which a refrigerant compressed in the compression chamber C is discharged. Here, the same reference numerals indicate the same constituent components of the scroll compressor of the prior art literature 2 illustrated in FIGS. 1 and 2, and a description applied in common is omitted.

Further, the compressor according to the present embodiment may further include an injection valve assembly 2700 that defines and opens or closes an injection flow path configured to guide a middle-pressure refrigerant to the compression chamber C from the outside of the housing 100 (e.g., from a downstream side of a condenser in a vapor compression refrigeration cycle including a scroll compressor, the condenser, an expansion valve, and an evaporator).

The housing 100 may include a center housing 110 penetrated by the rotary shaft 300, a front housing 120 configured to define, together with the center housing 110, a motor accommodation space that accommodates the motor 200, and a rear housing 130 configured to define a discharge chamber D that accommodates the refrigerant discharged from the compression chamber C, and the injection valve assembly 2700 may be interposed between the fixed scroll 500 and the rear housing 130. The injection valve assembly 2700 defines an introduction chamber I, into which the refrigerant is introduced from the outside of the housing, in the rear housing 130, and guides the refrigerant of the introduction chamber I to the compression chamber C.

Figure 3:
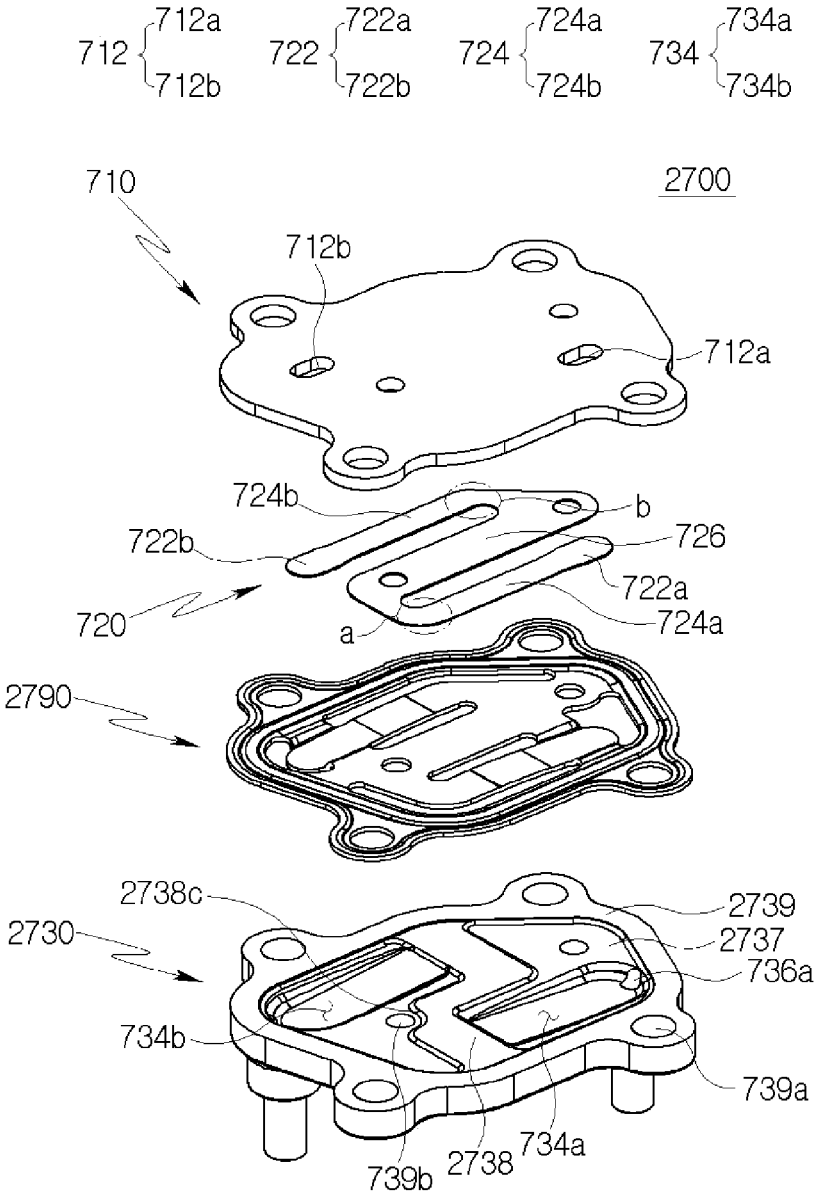
FIG. 3 is an exploded perspective view that illustrates an injection valve assembly of a scroll compressor according to an embodiment of the present disclosure.

Particularly, the injection valve assembly 2700 includes, as illustrated in FIG. 3, the cover plate 710 coupled to the rear housing 130 and having the inflow port 712 into which the refrigerant of the introduction chamber I is introduced, the valve plate 2730 coupled to the cover plate 710 and having an outflow port 736 through which the refrigerant introduced through the inflow port 712 is discharged, the gasket retainer 2790 interposed between the cover plate 710 and the valve plate 2730 and configured to prevent a leak of the refrigerant, and the injection valve 720 interposed between the cover plate 710 and the gasket retainer 2790 and configured to open or close the inflow port 712. Here, the same reference numerals indicate the same constituent components of the scroll compressor of the prior art literature 2 illustrated in FIGS. 1 and 2, and a description applied in common is omitted. That is, the constituent components of the cover plate 710 and the injection valve 720 are the same as the constituent components of the scroll compressor of the prior art literature 2.

Figure 4:
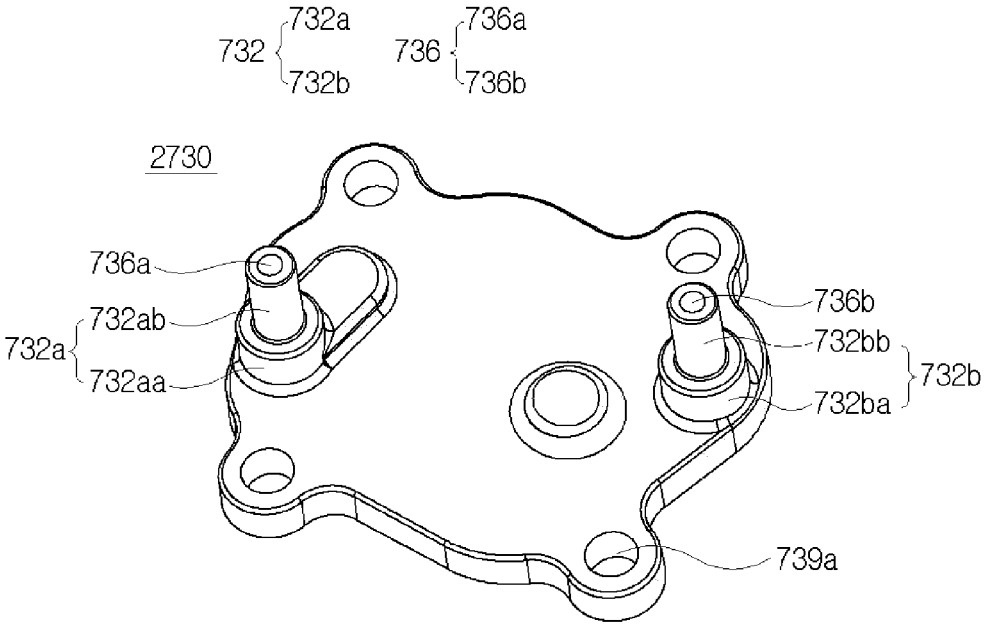
FIG. 4 is a rear perspective view that illustrates a valve plate of FIG. 3.

The valve plate 2730 according to the present embodiment, as illustrated in FIGS. 3 and 4, may include a protruding portion 732, an inclined space 734, the outflow port 736, a first fastening hole 739*a* and a second positioning groove 739*b* which are the same as the valve plate 730 of the prior art literature 2 in comparison therewith, however, there is a difference in that a surface pressure increasing portion 2738 and a step 2739 are formed on a surface of the valve plate 2730 facing the gasket retainer 2790. That is, a surface of the valve plate 730 facing the gasket retainer 790 of the prior art literature 2 is formed to be a flat surface except an inclined space 734, however the surface of the valve plate 2730 according to the present embodiment facing the gasket retainer 2790, has three different surfaces, each of which has a different height, except the inclined space 734.

Specifically, the surface pressure increasing portion 2738 is formed to protrude so as to support at least a part of the injection valve 720. That is, the surface pressure increasing portion 2738 is formed to protrude toward the gasket retainer 2790 from a base surface 2737 in which the inclined space 734 is formed to be depressed. Conversely, a height of the base surface 2737 is formed to be lower than that of the surface pressure increasing portion 2738.

At this instance, it is preferred that the surface pressure increasing portion 2738 supports a starting point at which opening or closing of the valve is performed in the injection valve 720, that is, a portion serving as a reference point when the valve is opened or closed. Accordingly, it is possible to reliably support the injection valve by increasing the surface pressure at a position requiring a support of the injection valve 720.

Specifically, when the injection valve 720 includes a head portion 722 configured to open or close the inflow port and a leg portion 724 extending from the head portion 722 and configured to perform an opening or closing operation, the surface pressure increasing portion 2738 may be provided at a position facing to an end of the leg portion 724 arranged opposite to the head portion 722.

In the present embodiment, the inflow port 712 is provided in plurality as the same as the prior art literature 2, and includes a first inflow port 712*a* and a second inflow port 712*b*, each of which are independently in communication with the introduction chamber I. In addition, as the same as the prior art literature 2, the injection valve 720 of the present embodiment includes a first head portion 722*a* configured to open or close the first inflow port 712*a*, a first leg portion 724*a* extending from the first head portion 722*a* and configured to perform an opening or closing operation, a second head portion 722*b* configured to open or close the second inflow port 712*b*, a second leg portion 724*b* extending from the second head portion 722*b* and configured to perform an opening or closing operation, and a connecting portion 726 configured to connect the first leg portion 724*a* and the second leg portion 724*b* to each other.

Here, positions requiring a support of the injection valve 720 are, as illustrated in FIG. 3, an end connecting the first leg portion 724*a* to the connecting portion 726 ('a' portion), and an end connecting the second leg portion 724*b* to the connecting portion 726 ('b' portion). This is because the first head portion 722*a* opens and closes the first inflow port 712*a* while bending at 'a' portion which serves as a reference point, and the second head portion 722*b* opens and closes the second inflow port 712*b* while bending at 'b' portion which serves as a reference point. Therefore, the surface pressure increasing portion 2738 may be provided at a position facing the 'a' and 'b' portions so as to support the 'a' and 'b' portions of the injection valve 720.

In addition, the surface pressure increasing portion 2738 may be provided at a position facing at least a part of the connecting portion 726 to ensure stable support for the injection valve 720. That is, the surface pressure increasing portion 2738 may be provided at a position traversing across the injection valve as well as at a position facing the 'a' and 'b' portions mentioned above, at the same time. At this instance, the surface pressure increasing portion 2738 is preferably formed to be a surface that integrally continues so as to be formed with an equal height.

In addition, the surface pressure increasing portion 2738 may be provided with an avoiding portion 2838*c* that is engraved so as to avoid the second positioning groove 739*b*.

The surface pressure increasing portion 2738 may be formed on a surface of the valve plate 2730 facing the gasket retainer 2790, and at the same time, a stepped portion may be formed in a circumference of the surface thereof. At this instance, the stepped portion may be formed by a step forming surface 2739 protruding further than a surface of the surface pressure increasing portion 2738 at a radially outside of the surface pressure increasing portion 2738.

Therefore, the surface of the valve plate 2730 facing the gasket retainer 2790 allows a height thereof to be lowered in order of the step forming surface 2739, the surface pressure increasing portion 2738, and the base surface 2737.

Here, the step forming surface 2739 faces the bead portion 2792 of the gasket retainer 2790 to be described below. Accordingly, when the injection valve assembly 2700 is fastened to the rear housing 130 by the fastening bolt 770, the step forming surface 2739 may seal between the valve plate 2730 and the cover plate 710 as the step forming surface 2739 presses to deform the bead portion 2792 so as to form a surface pressure.

At the same time, in a cavity formed on an inner side of the step forming surface 2739, an inner portion of the gasket retainer 2790 and the injection valve 720 may be seated. As the inner portion of the gasket retainer 2790 and the injection valve 720 are seated in the cavity, it is possible to lower a height of the bead portion 2792, in comparison with the prior art literature 2 in which a protruding height (h) of the bead portion 792 should be equal to or greater than a thickness (t) of the injection valve 720. Therefore, it is possible to prevent deformation of the gasket retainer 2790, and it is advantageous to form a shape of the gasket retainer and maintain a fastening force of the bolt. These advantages will be described further along with the description of the gasket retainer 2790 below.

In the present embodiment, the valve plate 2730 has been described to have a structure different from the valve plate 730 of the prior art literature 2, however, the present embodiment is not limited thereto, and the valve plate 730 of the prior art literature 2 may be applied to the present embodiment as well.

Figure 5:
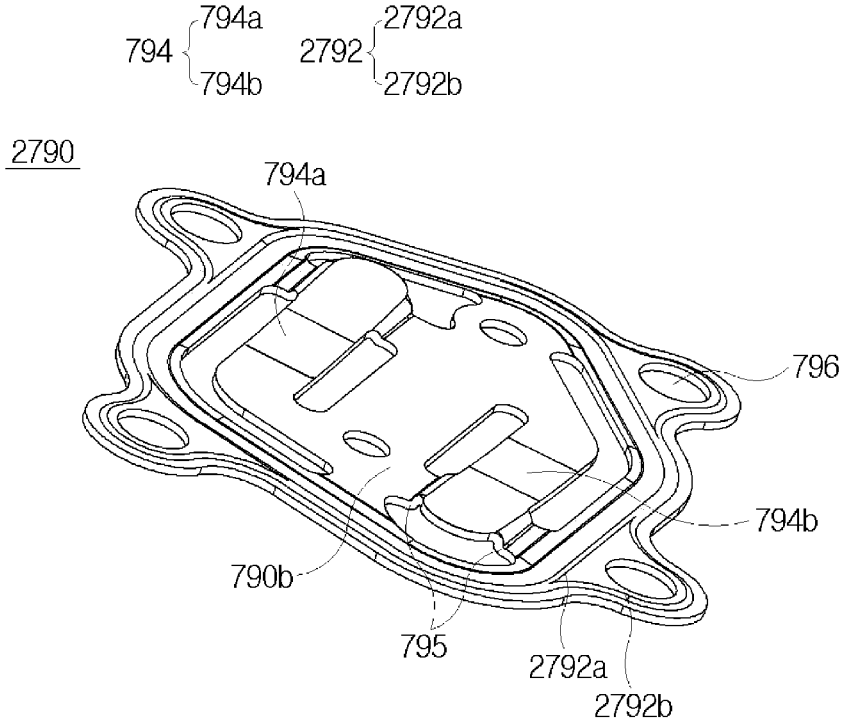
FIG. 5 is a rear perspective view that illustrates a state in which a gasket retainer of FIG. 3 is separated.
Figure 6:
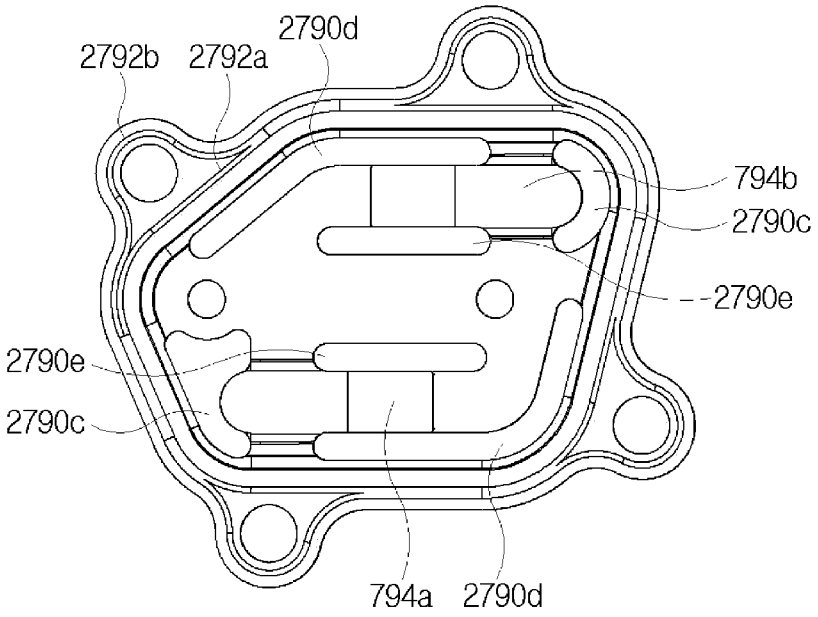
FIG. 6 is a plan view of FIG. 5.

Referring to FIGS. 5 and 6, the gasket retainer 2790 of the present embodiment includes a retainer portion 794 which is formed to be inclined in a direction in which the injection valve 720 is opened and a plurality of third fastening holes 796 formed to penetrate on a radially outside of the retainer portion 794 so that the fastening bolt 770 can be inserted thereinto, as the same as the prior art literature 2. However, there is a difference in that the bead portion 2792 includes the first half-bead 2792*a* and the second half-bead 2792*b*, and shapes of a main flow hole 2790*c* and a pair of auxiliary flow holes 2790*d* and 2790*e* are different from the prior art literature 2.

Specifically, the bead portion 2792 includes the first half-bead 2792*a* which is formed to protrude from one surface and extends radially inward of the plurality of third fastening holes 796 while surrounding the retainer portion 794, and the second half-bead 2792*a* which is formed to protrude from one surface and extends radially outward of the plurality of third fastening holes 796 while surrounding the first half-bead 2792*a*.

Here, unlike the prior art literature 2, the first half-bead 2792*a* and the second half-bead 2792*b* protrude from a bottom surface 790*b* of the gasket retainer which faces the valve plate 2730, but the present disclosure is not limited thereto.

At this instance, in a portion which is spaced apart from the plurality of third fastening holes 796, that is, in a space between adjacent third fastening holes 796, a convex full-bead is formed as the first half-bead 2792*a* and the second half-bead 2792*b* contact each other. As illustrated in FIGS. 5 and 6, the convex full-bead extends and as the full-bead adjoins the third fastening hole 796, the full-bead divides into the first and second half beads 2792*a* and 2792*b*, each of which extends inward or outward of the third fastening hole 796, respectively, and meets each other again and continues the extension as the full-bead.

For example, each of the first and second half beads 2792*a* and 2792*b* has a quarter circular cross-section, and the portion which is spaced apart from the plurality of third fastening holes 796 may have a semi-circular cross-section that is formed as the first and second half beads 2792*a* and 2792*b* contact each other.

As mentioned above, since the bead portion is formed around the plurality of third fastening holes 796 and the fastening force of the bolt may be supported around the third fastening holes 796 when the injection valve assembly 2700 is fastened to the rear housing 130 by the fastening bolt 770, it is possible to minimize deformation of the valve plate 2730.

Particularly, since the first half-bead 2792*a* and the second half-bead 2792*b* are configured respectively, around the third fastening hole 796 in which the surface pressure is intense so as to support the fastening bolt 770, and the first half-bead 2792*a* and the second half-bead 2792*b* contact each other and form the full-bead in the portion which is spaced apart from the third fastening holes 796 and in which the surface pressure is low, it is possible to prevent deformation of the valve plate 2730 through a uniform surface pressure.

In addition, in the gasket retainer 2790, in order to make one end of the retainer portion 794 from which an inclination starts not be directly connected to the adjacent first half-bead 2792*a*, holes extending to surround an outer side of the one end of the retainer portion 794 is formed. In the present embodiment, the first auxiliary flow hole 2790*d* to be described later serves as the hole extending to surround the outer side of the one end of the retainer portion 794. Accordingly, deformation which is generated when the bead portion 2792 is pressed is not transmitted to an inner side portion supporting the injection valve 720.

Particularly, as the same as the prior art literature 2, the retainer portion 794 is formed to be inclined by a cut in the body of the gasket retainer 2790, however, the gasket retainer 2790 further includes a pair of wing portions 795 which connects both sides of the retainer portion 794 to the body of the gasket retainer 2790 which faces the both sides, so as to maintain an inclination angle of the retainer portion 794. In this case, the pair of wing portions 795 is preferably connected to both sides of the other end of the retainer portion 794, which is opposite to the one end from which the inclination of the retainer portion 794 starts.

As described above, since the bead portion 2792 is not directly connected to the one end of the retainer portion 794, which supports the starting point (reference point) at which the opening or closing of the injection valve 720 is performed, deformation is not transmitted, and the pair of wing portions 795, which serve as a minimum connection, are connected to the other end of the retainer portion 794, the injection valve 720 may be reliably supported.

The main flow hole 2790*c* having a 'U' shape and surrounding the other end of the retainer portion 794 may be formed at one side of the pair of wing portions 795, and a pair of auxiliary flow holes 2790*d* and 2790*e* extending along a longitudinal direction of the retainer portion 794 may be formed at the other side of the pair of wing portions 795. At this instance, the first auxiliary flow hole 2790*d* positioned outward among the pair of auxiliary flow holes extends longer than the second auxiliary flow hole 2790*e* positioned inward and surrounds an outer side of the one end of the retainer portion 794. That is, as illustrated in FIG. 6, the second auxiliary flow hole 2790*e* extends as a straight line along a longitudinal direction of the retainer portion 794, while the first auxiliary flow hole 2790*d* may extend further by extending straight along a longitudinal direction of the retainer portion 794 and then being bent. The first auxiliary flow hole 2790*d* may be positioned on the same line as a line on which the second auxiliary flow hole 2790*e* is positioned or may extend to beyond the line.

Specifically, the retainer portion 794 is formed in plurality, and includes a first retainer portion 794*a* and a second retainer portion 794*b* spaced apart from the first retainer portion. In this case, the first auxiliary flow hole 2790*d* of the first retainer portion 794*a* may extend straight along a longitudinal direction of the first retainer portion 794*a*, and then be bent to extend toward the main flow hole 2790*c* of the second retainer portion 794*b*. The first auxiliary flow hole 2790*d* of the second retainer portion 794*b* may extend straight along a longitudinal direction of the second retainer portion 794*b* and then be bent to extend toward the main flow hole 2790*c* of the first retainer portion 794*a*.

Depending on circumstances, like the main flow hole 2790*c* positioned at a lower side based on FIG. 6, the main flow hole 2790*c* may at least partially extend along a circumferential direction of the gasket retainer 2790.

Figure 7:
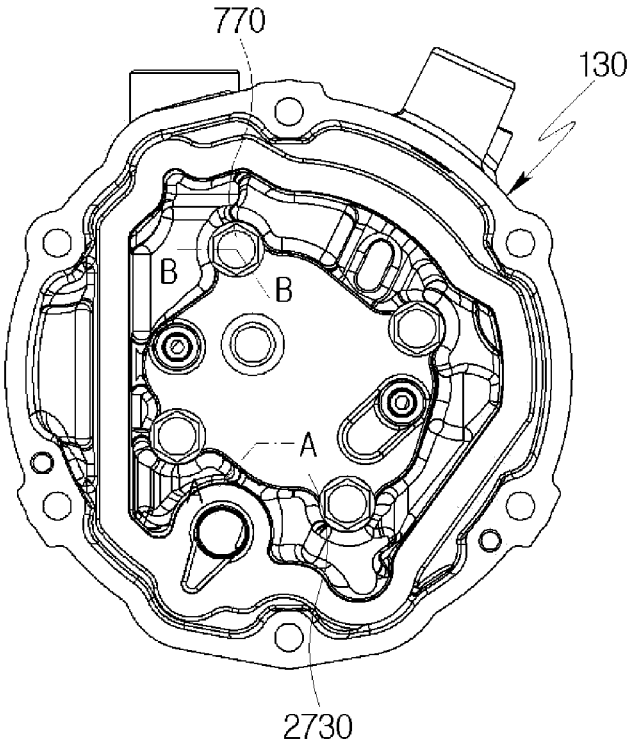
FIG. 7 is a plan view that illustrates a state in which an injection valve assembly of FIG. 3 is fastened to a rear housing.
Figure 8:
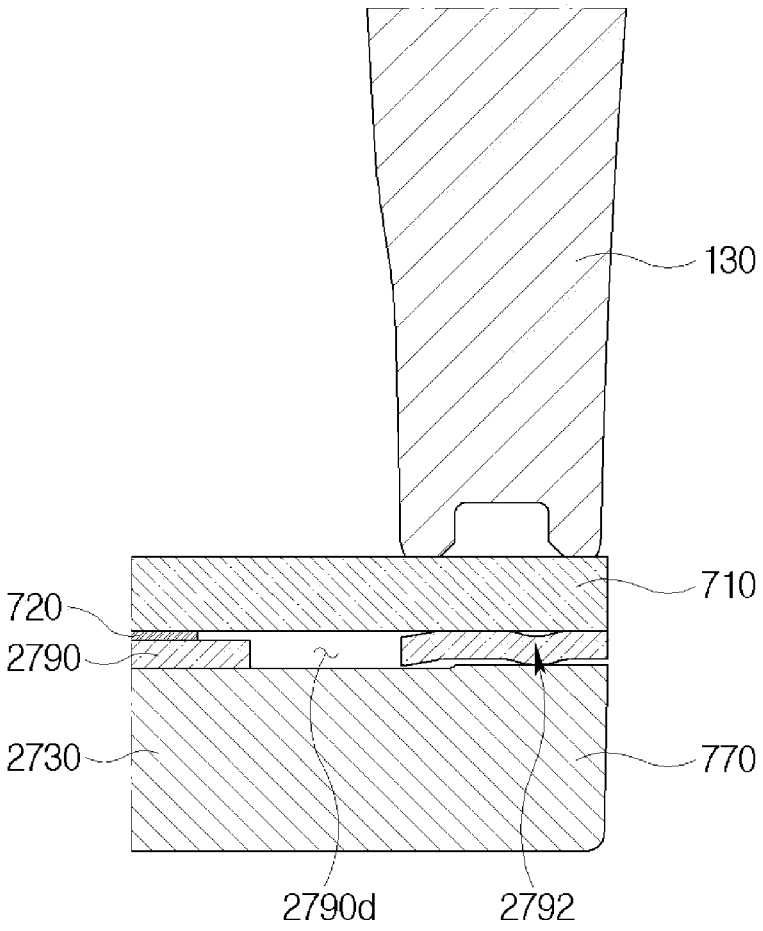
FIG. 8 is a cross-sectional view of A-A' part of FIG. 7.

Lastly, with reference to FIGS. 7 to 9, a state in which the injection valve assembly 2700 according to the present embodiment is coupled to the rear housing 130 will be described. FIG. 8 is a cross-sectional view of a portion spaced apart from the fastening bolt 770, and FIG. 9 is a cross-sectional view of a portion to which the fastening bolt 770 is fastened.

Referring to FIG. 8, the first half-bead 2792*a* and the second half-bead 2792*b* meet and form the full-bead at a portion which is spaced apart from the fastening bolt 770. In addition, since the retainer portion 794 is not directly connected to the bead portion 2792 by the first auxiliary flow hole 2790*d* and the deformation of the bead portion 2792 is not transmitted to the retainer portion 794, as a result, the retainer portion 794 maintains a flat state. In addition, in a cavity formed inside the step forming surface 2739 of the valve plate 2730, the inner portion of the gasket retainer 2790 and the injection valve 720 are seated.

Figure 9:
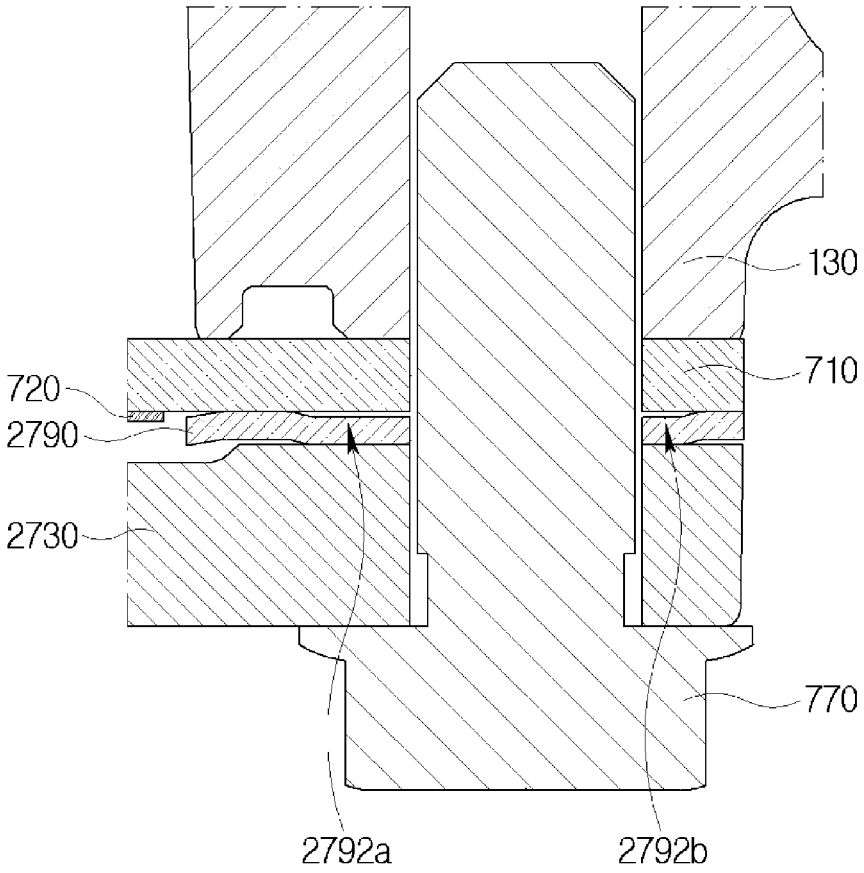
FIG. 9 is a cross-sectional view of B-B' part of FIG. 7.

Referring to FIG. 9, it can be seen that at a portion to which the fastening bolt 770 is fastened, the first half-bead 2792*a* and the second half-bead 2792*b* are formed on an inside and an outside of the fastening bolt 770, respectively, thereby the valve plate 2730 is supported and the deformation is minimized. Therefore, the deformation of the valve plate 2730 and the gasket retainer 2790 is minimized, the support for the injection valve 720 can be reliably provided, and operations can be stably performed.

The present disclosure is not limited to the specific exemplary embodiments and descriptions, various modifications can be made by any person skilled in the art to which the present disclosure pertains without departing from the subject matter of the present disclosure as claimed in the claims, and the modifications are within the scope defined by the claims.

The present disclosure relates to a scroll compressor, more particularly, a scroll compressor capable of minimizing deformation of a valve plate of an injection valve assembly, and maintaining a flat shape of the gasket retainer, since deformation is not transmitted to an inner side portion of the gasket retainer supporting an injection valve even when the bead portion of the gasket retainer is pressed.

The invention claimed is:

1. A scroll compressor comprising:

a housing;

a motor provided inside the housing;

a rotary shaft configured to be rotated by the motor;

an orbiting scroll configured to orbit in conjunction with the rotary shaft; and a fixed scroll configured to define a compression chamber together with the orbiting scroll, wherein the housing further comprises a rear housing which defines a discharge chamber configured to accommodate a refrigerant discharged from the compression chamber, wherein an injection valve assembly configured to define an introduction chamber into which a refrigerant is introduced from an outside of the housing in the rear housing and guide the refrigerant of the introduction chamber to the compression chamber is provided between the fixed scroll and the rear housing, wherein the injection valve assembly further comprises:

a cover plate coupled to the rear housing and having an inflow port into which the refrigerant from the introduction chamber is introduced;

a valve plate coupled to the cover plate and having an outflow port through which the refrigerant introduced from the inflow port is discharged;

a gasket retainer interposed between the cover plate and the valve plate and configured to prevent a leak of the refrigerant; and an injection valve interposed between the cover plate and the gasket retainer and configured to open or close the inflow port, and wherein the gasket retainer further comprises:

a retainer portion formed to be inclined in a direction in which the injection valve is opened;

a plurality of fastening holes formed to penetrate on a radially outside of the retainer portion so as to allow a fastening bolt to be inserted thereinto;

a first half-bead protruding from one surface and extending radially inward of the plurality of the fastening holes while surrounding the retainer portion; and a second half-bead protruding from one surface and extending radially outward of the plurality of fastening holes while surrounding the first half-bead.

2. The scroll compressor of claim 1, wherein the first half-bead and the second half-bead contact each other to form a convex full-bead at a portion spaced apart from the plurality of fastening holes.

3. The scroll compressor of claim 2, wherein each of the first half-bead and the second half-bead has a quarter circular cross-section, and wherein the first half-bead and the second half-bead contact each other to form a semi-circular cross-section at a portion spaced apart from the plurality of fastening holes.

4. The scroll compressor of claim 1, wherein the first half-bead and the second half-bead are formed to protrude from a bottom surface of the gasket retainer facing the valve plate.

5. The scroll compressor of claim 1, wherein a hole extending to surround an outside of one end of the retainer portion is formed in the gasket retainer so that the first half-bead adjoining the one end of the retainer portion from which an inclination starts are not directly connected to the one end.

6. The scroll compressor of claim 5, wherein the retainer portion is formed to be inclined by a cut of a body of the gasket retainer, and the gasket retainer further comprises a pair of wing portions connecting both sides of the retainer portion to the body of the gasket retainer facing each of the both sides of the retainer portion to maintain an inclination angle of the retainer portion, and wherein a main flow hole is formed on one side of the pair of wing portions, and a pair of auxiliary flow holes are formed on another side of the pair of wing portions, and wherein a first auxiliary flow hole disposed on an outer side of the pair of auxiliary flow holes extends longer than a second auxiliary flow hole disposed on an inner side of the pair of auxiliary flow holes to surround the outside of the one end of the retainer portion.

7. The scroll compressor of claim 6, wherein the first auxiliary flow hole is disposed on a same line as a line of the second auxiliary flow hole, or extends to beyond the line of the second auxiliary flow hole.

8. The scroll compressor of claim 6, wherein the pair of wing portions is connected to both sides of another end which are opposite to the one end of the retainer portion from which an inclination starts.

9. The scroll compressor of claim 6, wherein the retainer portion is provided in plurality, and comprises a first retainer portion, and a second retainer portion spaced apart from the first retainer portion, and wherein the first auxiliary flow hole of the first retainer portion extends toward the main flow hole of the second retainer portion, and the first auxiliary flow hole of the second retainer portion extends toward the main flow hole of the first retainer portion.

10. The scroll compressor of claim 6, wherein the main flow hole at least partially extends along a circumferential direction of the gasket retainer while surrounding another end which are opposite to the one end of the retainer portion from which an inclination starts.

11. The scroll compressor of claim 1, wherein a stepped portion is formed on a circumference of a surface of the valve plate facing the gasket retainer, and the stepped portion is formed by a step forming surface protruding toward the gasket retainer from the circumference of the valve plate, and wherein the first half-bead and the second half-bead face the step forming surface.

12. A scroll compressor, comprising:

a housing;

a motor provided inside the housing;

a rotary shaft configured to be rotated by the motor;

an orbiting scroll configured to orbit in conjunction with the rotary shaft; and a fixed scroll configured to define a compression chamber together with the orbiting scroll, wherein the housing further comprises a rear housing which defines a discharge chamber configured to accommodate a refrigerant discharged from the compression chamber;

an injection valve assembly configured to define an introduction chamber into which the refrigerant is introduced from an outside of the housing in the rear housing and guide the refrigerant of the introduction chamber to the compression chamber is provided between the fixed scroll and the rear housing, wherein the injection valve assembly further comprises:

a cover plate coupled to the rear housing and having an inflow port into which the refrigerant from the introduction chamber is introduced;

a valve plate coupled to the cover plate and having an outflow port through which the refrigerant introduced from the inflow port is discharged;

a gasket retainer interposed between the cover plate and the valve plate and configured to prevent a leak of the refrigerant; and an injection valve interposed between the cover plate and the gasket retainer and configured to open or close the inflow port, and wherein the gasket retainer further comprises;

a retainer portion formed to be inclined in a direction in which the injection valve is opened;

a bead portion protruding from one surface and surrounding the retainer portion, and wherein a hole extending to surround an outside of one end of the retainer portion is formed in the gasket retainer so that the bead portion adjoining the one end from which an inclination starts in the retainer portion is not directly connected to the one end.

* * * * *